United States Patent [19]

Morival

[11] 4,239,192

[45] Dec. 16, 1980

[54] METHOD AND APPARATUS FOR IMPROVING THE EFFICIENCY OF THE DEOXIDATION, DESULFURIZATION AND PURIFICATION OF STEEL IN THE POURING LADLE

[76] Inventor: Fernand Morival, Avenue Monier, 59178 Hasnon, France

[21] Appl. No.: 937,325

[22] Filed: Aug. 28, 1978

[30] Foreign Application Priority Data

Sep. 2, 1977 [FR] France ..... 77 27525

[51] Int. Cl.[3] ..... C21C 7/00

[52] U.S. Cl. ..... 266/216

[58] Field of Search ..... 266/216

[56] References Cited

U.S. PATENT DOCUMENTS

| | | | |
|---|---|---|---|
| 3,729,309 | 4/1973 | Kawawa | 266/216 |
| 4,010,938 | 3/1977 | Crudup | 266/216 |
| 4,066,248 | 1/1978 | Hoffmeister | 266/216 |

*Primary Examiner*—P. D. Rosenberg

*Attorney, Agent, or Firm*—Frailey & Ratner

[57] ABSTRACT

The present invention concerns a process and apparatus for improving the efficiency of the deoxidation, desulfurization and purification of molten steel in the pouring or casting ladle by the injection of a band of metal and/or a selected quantity of a granular or powdery addition product into a bath of molten steel in a ladle, wherein a band drive assembly is disposed above, in proximity to, the surface of the molten bath and is operative to propel vertically a band of metal in rectilinear form, perpendicularly to the surface of the molten bath, deep into the bath so that the metal band approaches as closely as possible the bottom of the ladle to improve the distribution of the metal and the addition product throughout the molten bath.

19 Claims, 17 Drawing Figures

METHOD AND APPARATUS FOR IMPROVING THE EFFICIENCY OF THE DEOXIDATION, DESULFURIZATION AND PURIFICATION OF STEEL IN THE POURING LADLE

BACKGROUND OF THE INVENTION

For a decade, industrial demands on steel have become more and more severe because of the increasingly large mechanical stresses to which manufactured apparatuses are subjected and the reliability which is demanded of such apparatuses. The mechanical construction industry demands from steelmakers steels which have characteristics never before required, particularly as regards steel plates for welded structures.

This requires the steel technologists to solve numerous problems in order to reduce the risks of delamination and of anisotropy of steel plates. It is known that such delamination is due to inclusions of oxides and sulfides which have been greatly drawn out during rolling and which are present beneath a weld bead, parallel to the surface of the plate.

The steelmaker's efforts are thus centered on processes which can reduce inclusions of sulfides and oxides and the formation of flakes.

For this purpose, a high-quality metal has to be produced by:

reducing the sulfur content to less than five parts per thousand, reducing the quantity of oxides and sulfides, attempting to obtain inclusions of globular shape, uniformly distributed and pouring easily, limiting the hydrogen content.

It has been established that the injection of alkaline earth metal (silico-calcium, silicon carbide) into steel contained in a ladle having a basic lining results in an extremely low oxygen content and a very considerable lowering of the sulfur content, which prevents formation of manganese sulfide (easily deformable and the cause of dangerous inclusions).

The alkaline earth metals reduce the proportion of metallic oxides $SiO_2$, $Al_2O_3$, giving rise to the presence of calcium silicate and aluminate having a low melting point, which favors their agglutination into large ferric droplets which pour easily and result in the production of a relatively clean metal of improved castability.

The large inclusions which are present (globular calcium aluminate) are not deformable at rolling temperatures, so that linearly drawn-out inclusions are not present, which give rise to delamination.

Several metallurgical processes have been advised for this purpose.

PRIOR ART AND DISADVANTAGES

The process which is most used at present is a process which was developed by the firms of THYSSEN, CAB and IRSID. It consists of treating the metal in the pouring ladle by blowing commercial calcium alloys (silico-calcium, silicon carbide in granulated form) into the steel bath by means of an inert gas, generally argon, through a hollow plug at the end of a nozzle (hollow rod) of refractory material immersed as deeply as possible close to the bottom of the ladle, so as to increase the duration of contact of the calcium addition with the metal.

This process requires:

(a) cumbersome and expensive equipment;

(b) carrying out converter pouring at very high temperatures, to the detriment of the life of the refractory linings of the converters and of the pouring ladles, since the severity of the period of rabbling causes a considerable fall in the temperature of the metal which has to be compensated.

For satisfactory desulfurization and elimination of nonmetallic inclusions, it is necessary:

(1) to operate with a basic lining;

(2) to have a slag with a low charge of iron and other oxides;

(3) to have, on the other hand, a slag which is deoxidized, rich in limestone and fluid;

(4) that the metal be well deoxidized;

(5) that the temperature of the metal be high;

(6) that it be possible to mix the metal and deoxidized slag by means of argon;

(7) that calcium or alkaline earth mixture can be readily added several times and as close as possible to the bottom of the ladle, if possible by means of a simple, compact, inexpensive, rapid, handy and reliable apparatus.

Conditions, 2, 3 and 4 are imperative and cause slight but essential modifications to the process of manufacture.

In fact, it is necessary today to manufacture increasingly clean steels, and it is universally known that the refining of steel involves numerous chemical interactions between the metal and the slag.

Now, at the present time, the metal poured into a ladle is covered by a part of the slag which had been used for refining, so that in the purification operations consisting of mixing the metal with slag charged with oxide, it is clear that the products intended to purify the metal (alkaline earth metals or others) also have to purify the slag, whereby a low yield of purified products results.

The process which has been described can be carried out by means of apparatuses which are the result of improvements to apparatuses designed to inject a continuous ribbon or band of aluminum of well-defined shape, cross section and hardness, in order to carefully compose steel intended for continuous casting, to obtain an aluminum content falling within very narrow limits. Such apparatuses have been described in French Pat. Nos. 2,112,093 and 2,184,456, which disclose both the process and the apparatus, the latter comprising a reel carrying at least one roll of ribbon, and a fixed driving assembly pulling on the ribbon to direct it downward, line it up, and push it towards the ladle at a set speed such that it enters the surface of the liquid steel perpendicularly in order not to risk deviating obliquely to be lost in the slag or to fail to end up on the bottom of the ladle, the driving assembly being constituted by a series of driving rollers, on one side, and by a series of double-flanged supporting counter-rollers, on the other side of the ribbon, the counter-rollers being mounted on a movable yoke which can be moved towards and away from the driving rollers by means of rams, to pinch and drive the ribbon. The driving rollers are generally provided with ridges to improve adherence with the ribbon.

The increasingly rigorous conditions to which steels are submitted require steelmakers to produce a metal containing a very small quantity of aluminum, kept within very narrow limits. The initial apparatus thus had to be improved so as, on the one hand, to rigorously control the quantity of aluminum injected and, on the other hand, to vary this quantity according to the degree of oxidation of the metal, in order to obtain, in each case, to within several thousandths of units, the optimum quantity of aluminum in the metal.

It has further more been shown, according to the apparatuses described in the patents cited above, that on account of the dusty atmosphere of steelworkers, the caterpillar chain was subject to breaking and that is was preferable to replace it by the serrated rollers disclosed in French Pat. No. 2,184,456. It was also pointed out that is was indispensable to specify the physical characteristics, shape, cross section, hardness, etc., of the aluminum ribbon which would give the best and most reliable results. With castings attainting greater and greater weights, it was also found necessary to provide apparatus of greater capacity, which entailed certain modifications as compared with the initial apparatuses.

The object of the present invention is to remedy the foregoing disadvantages and to take into account the requirements of the evolution of steelmaking.

SUMMARY OF THE INVENTION

According to the invention, the process is characterized by the combination of the following operations:

(a) before the metal is poured, there is provided at the bottom of the ladle a selected quantity of a fluid, a basic liquid slag, free of oxides and sulfates and possibly containing deoxidizing and purifying elements, the whole having been melted beforehand in order to obtain:

a slag having a low charge of iron and other oxides, and which is fluid and rich in lime, a metal which is well deoxidized at a temperature higher than normal, (b) the metal is poured, while preventing the converter's refining slag from accompanying it, (c) the metal and deoxidized slag are mixed, preferably by means of argon, (d) additions of calcium or of alkaline earth mixture are made repeatedly and as close as possible to the bottom of the ladle.

The slag which is provided beforehand at the bottom of the ladle can either be prepared in a special apparatus and then be poured into the ladle, or can be made in situ in the ladle, where it is prepared:

(a) by arranging for the internal temperature of the ladle to be maintained at 600°–700° C., (b) by depositing at the bottom of the ladle all the aluminum ingots needed for a first deoxidation, as well as a mixture of limestone (80/90%) and of fluorspar or carbonate of soda (10–20%) and possibly of other fluxes based on calcium and on calcium carbide, (c) by taking every precaution to prevent these powdery products from producing an appreciable release of dust during the pouring of the steel into the ladle.

These precautions can consist, for example, of covering the powdery mixture with a sheet of steel.

The apparatuses of the invention enabling the process defined above to be carried out are characterized by means adapted to inject a well-defined quantity of addition products and a ribbon or band which is as straight as possible, namely:

(a) means for precise measurement of the length of ribbon supplied;

(b) receptacles containing the addition products fixed to the lower ends of bands or bars, the material constituting the receptacles being selected so as to be destroyed only at the moment when the receptacle has reached the bottom of the ladle filled with molten steel, with the band or bar which pushes it there, (c) a support device for the receptacles, with a trapdoor which opens above the ladle only at the moment of descent of the bar with the receptacle which it pushes downward.

Preferably the trapdoor comprises two components, which slide in opposite directions under the action of at least one double acting ram. Each of the trapdoors is protected underneath by a refractory material.

In one preferred embodiment, bands or bars having lengths determined according to requirements and particularly depending upon the distance between the driving assembly and the bottom of the ladle, are kept in readiness (before being inserted manually into the driving assembly and possibly provided at their lower ends with a receptacle containing the prescribed portion of addition product) in a rack composed of a lower receptacle, in the form of a box open at the top, and an upper support in the form of a rectangular band having a vertical axis, one side being designed to open and close to insert and retain the bands. Furthermore, the receptacles containing the addition products include, on top, a female connector into which the lower ends of the bands or bars can engage, corresponding holes being provided in the connector and the bar for the insertion of a locking pin.

Moreover, the apparatus is characterized by an assembly of means designed to inject a well-defined and substantial quantity of aluminum bands, as straight as possible, and of addition products, namely:

(a) a ribbon or band of aluminum wound helicoidally in successive layers on the reel of an unwinder, in the manner of a textile thread on its bobbin;

(b) a reel which is arranged so it can oscillate axially with a movement of amplitude equal to its width to follow the helicoidal movements of the ribbon as it unwinds from the reel, (c) a guide wheel deflecting the ribbon downward, such wheel having a groove with flanges which can act on the ribbon to displace the reel correctly during unwinding, the guide wheel also including means for accurate measuring of the length of the unwound ribbon, (d) a detwister to flatten the unwinding ribbon.

Because the atmosphere of the workshops is dusty, it has been found suitable to support the reel by a smooth longitudinal axle having a length at least twice the width of the reel. The hub of the reel includes self-lubricating bearings, so the reel can turn very freely while being easily displaced axially during unwinding.

Different devices for measuring the length of the aluminum ribbon or band were possible, but it was found convenient to insert a material having a high coefficient of friction at the bottom of the groove of the guide wheel, and to mount a plurality of arcuately disposed, uniformly spaced passive electrical contact studs on one or both of its flanks or flanges. The studs cooperate with a fixed detector emitting measuring pulses to a counter which controls the running and stopping of the motor of the drive assembly, the angular distance between the studs corresponding to a defined length of the ribbon in relation to its weight.

Alternatively, in place of the ribbon, aluminum bands or bars of selected length may be used, which are stored in the rack previously mentioned, and inserted manually into the drive assembly.

According to a preferred embodiment of the invention, the detwister is composed of two series of rollers having axes parallel to those of the rollers of the drive assembly, the said series of rollers each gripping opposite halves of the ribbon and being capable of being displaced in opposite directions, perpendicularly to the widest sides of the ribbon. The detwister is located upstream of the drive assembly.

To facilitate maintenance operations and the replacement of the movable part of the apparatus, which is the most delicate part and which alone can undergo malfunctions, the drive assembly is composed of an ensemble mounted on a removable plate which is easily interchangeable.

Most users prefer to have large capacity apparatus having a reserve unwinder. Others prefer using a reel of ribbon of a weight approximately equal to the total weight injected, together with a second reel of ribbon which is injected in a carefully metered manner to adjust precisely the final weight of the addition. In these two cases, an unwinder is provided which includes two reels on the same axle supported at its middle by a pivotal column, which can be locked in unwinding position and constitutes a type of swivel. In this case, one reel can be reloaded while the other is being unwound.

The adjustment of the precise quantity also can be effected by the use of bands or bars stored in the rack and having selected lengths.

To facilitate the introduction of the aluminum ribbon, bands or bars through the trapdoor, the latter includes a small opening in which can be placed a funnel-shaped guide.

Furthermore, the detwister is mounted on an articulated support, permitting it to be put out of action when rigid straight bands or bars stored in the rack are used.

As for the aluminum ribbon, numerous trails have shown that a ribbon should be used which has been cold-rolled to flatten it while retaining its two edges rounded, with its width equal to about twice its thickness, and with its cross section comprised between 150 and 450 $mm^2$. More precisely, an aluminum ribbon is used having a purity of at least 99.5%, a cross section of 300 $mm^2$ and a Brinnell hardness of about 23.

The apparatus is described herein for injecting in rectilinear form a ribbon, band or bar of aluminum, but it can be used for injecting a ribbon, band or bar of similar cross section of any metal, and even of any product whatever. In the case of powdery products, they may be enclosed within a tube of the same cross section as a bar provided in the present specification.

SOLUTION OF THE PROBLEM, AND ADVANTAGES

As a result of the process described above, utilized with the apparatuses which have been described, there is obtained at the end of pouring a deoxidized metal covered by a fluid slag rich in lime, since the conditions 1, 2, 3, 4 and 5 set out on page 3 of the present specification have been fulfilled. Condition 6 is satisfied from the moment when the mixing with argon is carried out, either by means of a porous brick or by a hollow rod. Condition 7 which, up to the present, was satisfied by means of a complicated and expensive installation, is easily satisfied by the apparatuses of this invention which have been described.

In fact, with these apparatuses it is possible to inject in rectilinear form a continuous ribbon, band or bar of aluminum or other metal, as well as any granular or powdery products which have been prepacked in receptacles according to specified characteristics, each receptacle being attached to a band or bar of appropriate dimensions so that it can be maintained, guided and driven by the system which has been described. The receptacles are of a size which make it possible to manipulate them by hand (volume 25 liters approximately, and weight 75 kg maximum).

One or more receptacles can be utilized for quickly and accurately injecting the necessary quantity of addition products for carryng out the task on hand.

Calcium in addition to its property of reducing sulfides and oxides, enables voluminous impurities to be formed and a rapid separation to be obtained.

Aluminum treated steels are generally loaded with alumina, which creates a relatively thick metal, of sometimes difficult pourability owing to blocking up of nozzles.

To remedy this, it is possible:

(a) after treating with aluminum and the formation of a special slag, to inject, in several stages, a calciumfluorspar composition, stored in the receptacles described above;

(b) during these operations, effect a mixing by injecting argon by the usual means (porous brick or hollow rod).

Because of the great affinity of calcium for aluminum, there occurs the formation of calcium aluminate in the form of globules.

The form and dimensions thus given to the inclusions permits them to be separated more easily; this gives a particularly clean metal, with increased pourability, resulting in a very considerable improvement in the continuous casting of the metal.

It is also possible, proceeding in the same manner, to carry out:

(1) purification of silicon treated steels;

(2) an addition or a correction of carbon, in the form of either pure carbon or calcium carbide;

(3) any other metallic addition or correction, based on manganese, zirconium, niobium, cerium, molybdenum, vanadium, etc.

Summing up, it is possible, by means of the process of the invention and of the apparatuses which enable it to be applied, to:

(a) reduce the range of residual aluminum contained in certain steels, (b) reduce the sulfur content of all steels, (c) reduce the content of non-metallic inclusions, (d) obtain a clean metal with increased pourability at controlled pouring temperature, and with the content of carbon, manganese, aluminum and sulfur maintained with precision within narrower ranges.

Finally, the totality of these improvements enables steels to be obtained with heightened mechanical characteristics (resilience, cold-drawability, strength at low temperature, deformability at ambient temperature, in all directions, improved weldability, etc.), and at very competitive prices.

DESCRIPTION OF THE FIGURES OF THE DRAWING

The invention will be better understood with the aid of the following description, which gives non-limiting examples of various embodiments thereof, and which are illustrated by the attached drawing in which.

Figure 1:
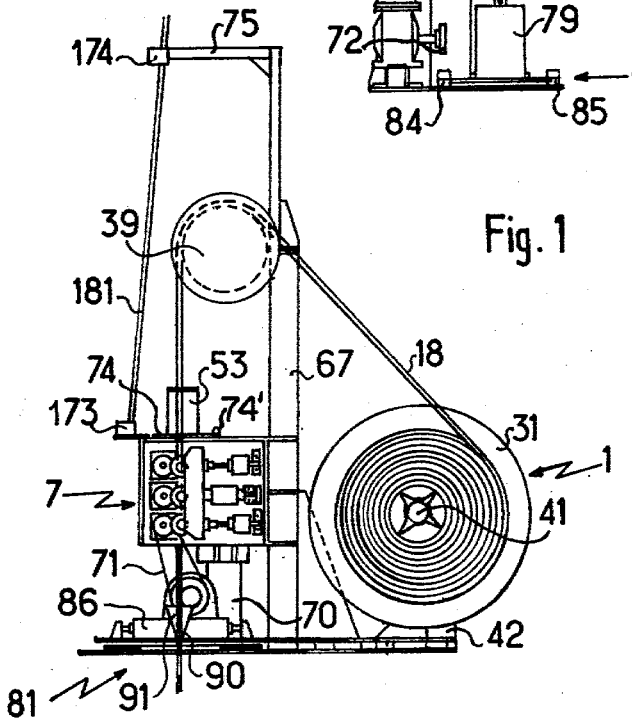
FIG. 1 is a view in front elevation of a preferred apparatus embodying the invention, with a supply of aluminum stored in the form of a wound up ribbon or band.
Figure 3:
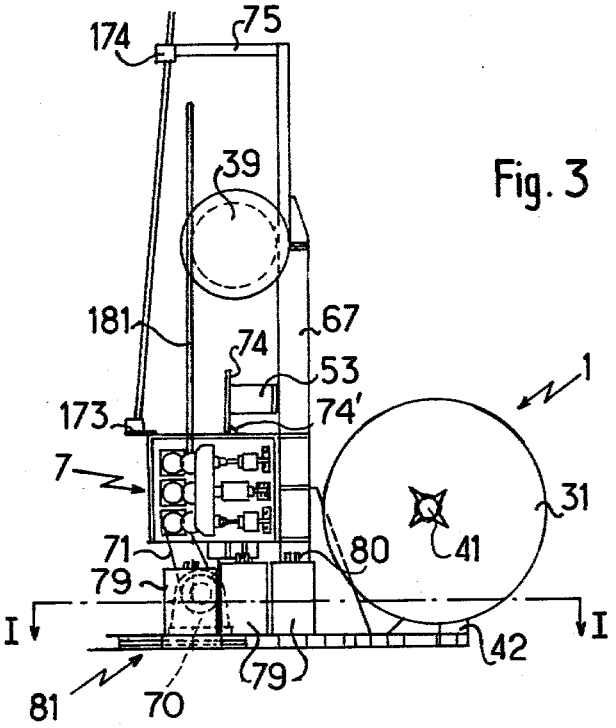
FIG. 3 is a view in front elevation of the apparatus illustrating a supply of rectilinear bands or bars of fixed length which first have been stored on a rack, and which are connectable to receptacles containing, for example, powdery addition products.
Figure 5:
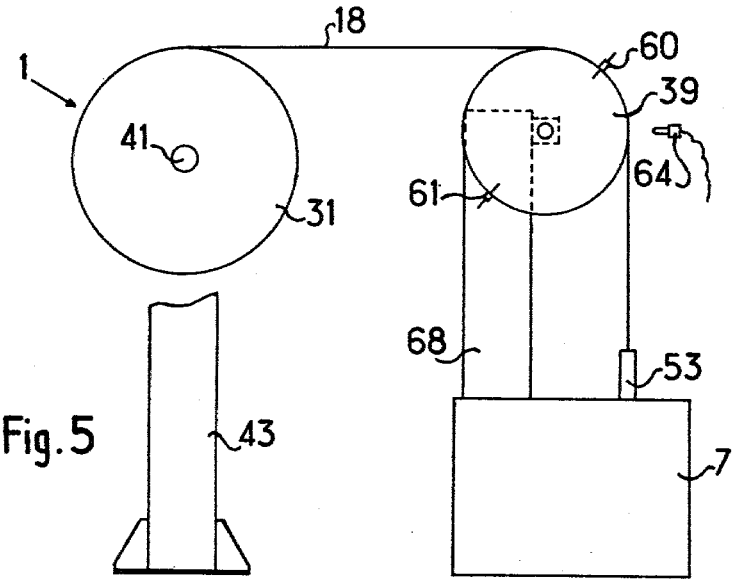
FIGS. 5, 6, 7 and 8 are schematic views of four embodiments of apparatuses of the invention suited to different steelworks uses.
Figure 6:
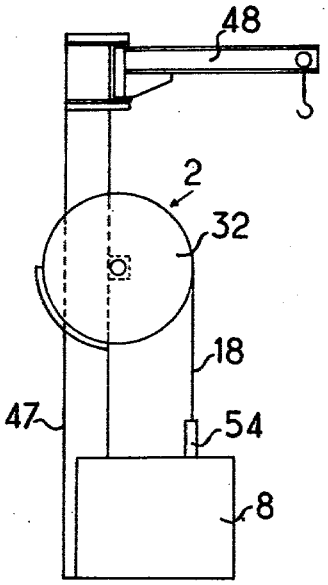
Figure 7:
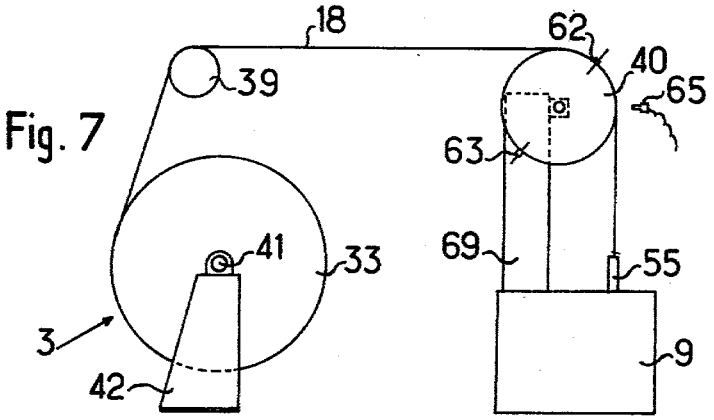
Figure 8:
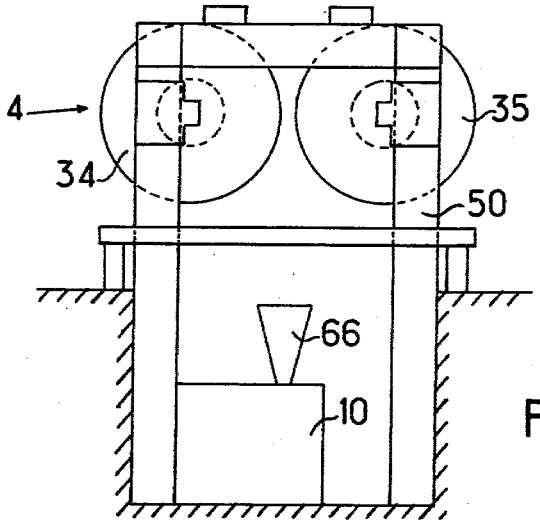
Figure 11:
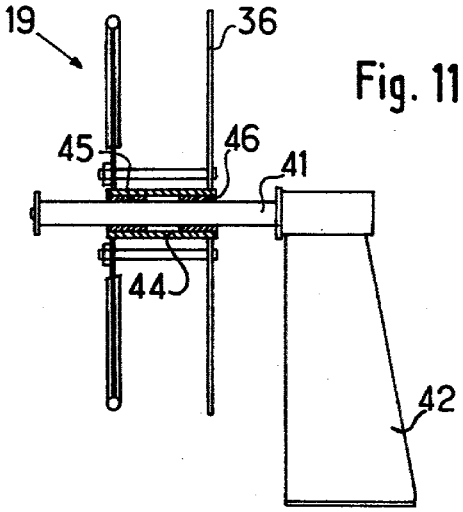
FIG. 11 is a vertical section of a reel unwinder with its support, taken in the plane of its axle.
Figure 12:
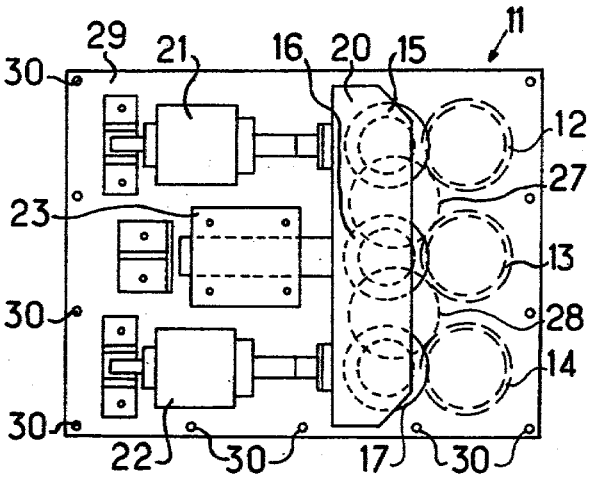
FIG. 12 is a view in front elevation of the drive assembly.
Figure 13:
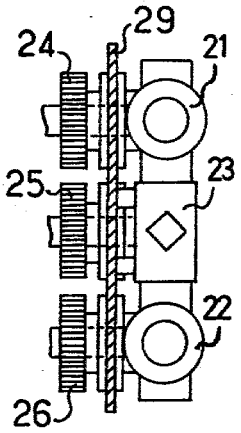
FIG. 13 is a side view of the drive assembly shown in FIG. 12.
Figure 14:
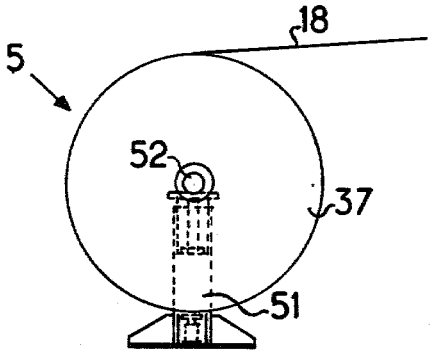
FIGS. 14 and 15 are views, respectively in elevation and in plan, of a pivotal unwinder with two reels.
Figure 15:
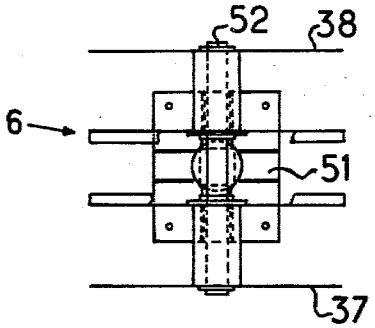

The apparatus includes an unwinder, referenced by 1 in FIGS. 1, 3 and 5, by 2 in FIG. 6, by 3 in FIG. 7, by 4 in FIG. 8, by 5 in FIG. 14 and by 6 in FIG. 15, and a drive assembly referenced by 7 in FIGS. 1, 3 and 5, by 8 in FIG. 6, by 9 in FIG. 7 and by 10 in FIG. 8. An unwinder is shown in detail at 19 in FIG. 11, and a drive assembly is shown in detail at 11 in FIG. 12. The drive assembly (FIGS. 12, 13) essentially comprises grooved drive rollers 12, 13, 14, directly driven by gear wheels 24, 25, 26, the rotation of which is synchronized by gear wheels 27, 28. The grooved rollers 12, 13, 14 pull on the ribbon or band 18, gripping it between themselves and their mating rollers 15, 16, 17 mounted on a movable yoke 20 actuated by rams 21, 22 and supported by a guide slide 23. The rollers 12, 13, 14, their mating rollers 15, 16, 17, the yoke 20, the rams 21, 22, the slide 23 and the gear wheels 24 to 28 are supported by a plate 29 removably fixed by screws 30 to the frame of the apparatus. This disposition makes the assembly easily removable to facilitate repairs.

The drive assembly 7 (FIG. 1, 2), and more precisely the grooved drive rollers 12, 13, 14 driven by the gear wheels 24 to 28, is driven from a combination motor and reduction gear 70 by a chain 71 which connects two spaced chainpulleys 72 and 73 keyed, respectively, to the motor-reduction gear 70 and to the shaft of the drive roller 14.

Figure 9:
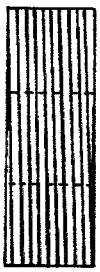
FIG. 9 is a front view of a reel of a wound-up aluminum ribbon according to the invention.
Figure 10:
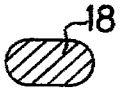
FIG. 10 is a section of the aluminum ribbon or band of the invention.
Figure 17:
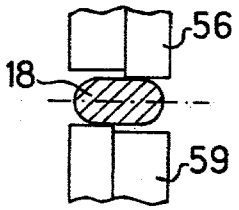
FIG. 17 is a section along line A—A of FIG. 16.

The ribbon 18 has the cross section shown in FIGS. 10 and 17, i.e., a flattened shape with rounded edges, and preferably, in the example shown, has a cross section of 300 $mm^2$, a width of 24 mm and a thickness of 12.5 mm. These two dimensions have been selected for reasons of economy, since it is easier to withdraw from a reel cast machine wires manufactured by continuous rolling after melting. Cold rolling is carried out at a selected temperature sufficient to obtain an aluminum ribbon or band of about 23 Brinnell hardness. This cross section, together with the hardness mentioned, enables a ribbon to be obtained which is sufficiently flexible to form regular coils of several turns, such as shown in FIG. 9, to constitute reels in which the ribbons are wound helicoidally in successive layers, in the manner of a textile thread on its bobbin. The quality of aluminum is such that the ribbon can undergo several manipulations without permanent deformation and without risk of accident from the spring effect of released turns.

The ribbon itself is sufficiently tough to pass in rectilinear from vertically through the molten metal in the ladle and its layer of slag without bending in any plane, so as to be able to approach as closely as possible to the bottom of the ladle to improve the distibution of the aluminum in the metal and to contribute to obtaining a maximum chemical yield. Repeatedly obtaining very precise results has to be assured in order to attain the desired goal, namely, a precentage of residual aluminum maintained within narrow limits. The thickness of a layer of aluminum wound on one of the reels 31 to 38 may be 250 to 500 mm, depending on the quantity of aluminum necessary for the treatment and the process chosen for the treatment.

The apparatus usually includes one or two guide wheels 39, 40 interposed between the reels 31 to 38 and the drive assemblies 7 to 11 and supported by a column 67, 68, 69. The guide wheels direct the ribbon 18 downward, and have peripheral grooves with flanges which acct on the ribbon so that is is correctly placed flat against the wheel, in spite of the helicoidal winding of the reels 31 to 38, shown in FIG. 9. Lateral forces thus are exerted on the ribbon by the guide wheels 39, 40, forces which react on the reels 31 to 38 as lateral stresses causing each reel to be displaced axially on its axles 41 (FIG. 11) with an amplitude equal to its width. The axle 41 is maintained by a support 42 (FIGS. 1, 7, 11) or 43 (FIG. 5) and is perfectly smooth. For this purpose, it is provided with a hard and polished chromium plating. It is at least twice as wide as the reel. The hub 44 of the reel includes self-lubricating rings 45, 46 which are of "TEFLON" and which permit not only the rotation of the reels 31 to 38, but also their displacement laterally on the axle 41.

In the embodiment of FIG. 6, the reel 32 is maintained by a support 47 which is part of the crane 48 for handling the reels of ribbon 18.

In the embodiment of FIG. 7, an intermediate wheel 39 is provided and guides the band 18 in cases where the reel 33 is larger and must be separated from the apparatus proper.

In the embodiment of FIG. 8, the two reels 34 and 35 are supported by a framework 50 which overhangs the apparatus.

In the embodiment of FIGS. 14 and 15, an unwinder has been provided with two reels 37, 38 which are sustained by a single vertical support 51 at the middle of the axle 52. Support 51 is constituted by a pivotal column able to be locked at two unwinding positions located 180° apart.

Figure 16:
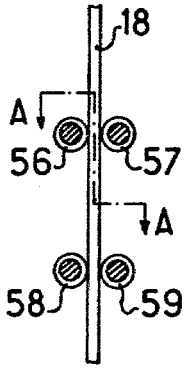
FIG. 16 is a side view of a detwister.

An important detail of the apparatus of the invention resides in the detwisters 53, 54, 55, the principle of which is explained in FIGS. 16 and 17. The ribbon or band 18 is subjected, between the reels 31, 33, in particular, and the guide wheels 39, 40 to lateral stresses which create torsions causing jamming of the apparatus because the ribbon wedges between the drive rollers and their mating rollers. This disorganizes the chemical treatment of the steel, often downgrading it. Because of this, a detwister 53, 54 or 55 has to be used, constituted by a metallic frame within which are mounted two series of rollers 56, 57 and 58, 59 with axes parallel to those of the rollers of the drive assemblies 7 to 11. The rollers 56, 57 grip one half of the ribbon 18, while the rollers 58, 59 grip the other half of the ribbon. The series of rollers 56, 57 and 58, 59 respectively push the ribbon 18 in opposite directions perpendicularly to the widest side of the ribbon. The direction in which the ribbon 18 is pushed depends on the direction of kinking of the ribbon which, at the discharge end of the detwisters 53, 54, 55, is thus flat and can pass without hindrance rectilinearly into the drive assemblies 7, 8, 9, 10, 11.

The combination of guide wheels 39, 40, detwisters 53, 54 or 55 and drive assemblies 7, 8, 9 or 10 constitute straightening means as well as injection means for the ribbon or band 18 to ensure that it is propelled vertically in rectilinear form deep into the bath of molten steel close to the bottom of the ladle. To further ensure this advantage, the ensemble constituting the ribbon injection means is located above, and in proximity to, the molten steel bath in the ladle.

Another important detail of the invention consists of the means for measuring precisely the length of a band of unwound ribbon of aluminum. For this, the guide wheels 39, 40 and/or one or more of the drive rollers 12, 13, 14, include arcuately spaced passive contact studs 60, 61 or 62, 63 (FIGS. 5, 7), disposed uniformly on one side, which cooperate with a fixed detector 64 or 65 that emits measuring pulses to a counter (not shown). Studs similar to studs 60 to 63 should be mounted on drive rollers 12, 13, 14. The rollers 12, 13, 14 are grooved and their rotation is precisely proportional to the length of ribbon 18 supplied. The bottom of the grooves of the guide wheels 39, 40 are lined with a material having a high coefficient of friction, such as used for brake linings, so that the rotation of each guide wheel is strictly proportional to the speed of the ribbon 18. The counter receiving the pulses from the detectors 64, 65 controls the running and stopping of the motors which actuate the drive assemblies 7, 8, 9, 10, 11. In this manner, the quantity of aluminum delivered by the apparatus can be precisely determined. For greater precision, the diameter of the wheels 39, 40 and the spacing between the studs 60, 61 or 62, 63 can be calculated to ensure that the distance between two studs corresponds to a carefully determined weight of aluminum. The apparatus thus operates automatically.

With the swivel shown in FIGS. 14 and 15, it can be arranged, for example, for the reel 37 to contain an approximate weight of aluminum for the treatment, such weight being slightly less than the necessary amount, while the reel 38 contains the aluminum which will be injected later, according to the precise additional quantity needed, as determined by analysis of the steel after injection of the aluminum contained on the reel 37.

The embodiments of FIGS. 5 to 8 depend on the topography of the steel works. In the embodiment of FIG. 8, it has been foreseen that it would be useless to install a detwister, which has been replaced by a simple wire guide 66.

Figure 2:
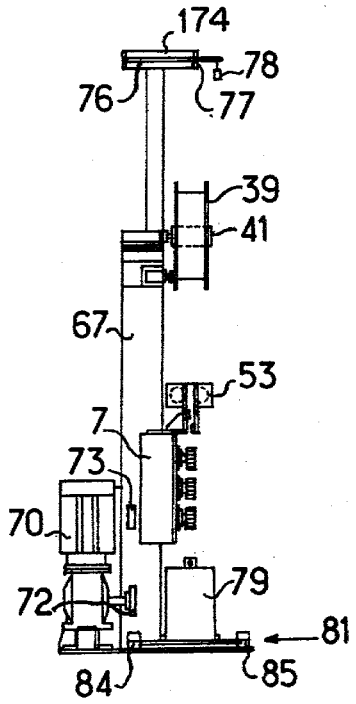
FIG. 2 is a side view of the apparatus of FIG. 1, with the wound-up ribbon omitted.

Another way to measure precisely the length of ribbon or band to be injected into the bath of molten steel is to provide a series of rectilinear bands or bars 181 of precise length (FIGS. 1, 3), which can be inserted manually into the drive assembly 7. The bands 181 can be of any metal whatever; they obviously can be aluminum. If it is desired to make additions of other metals, the bands may be constituted of such metals, provided their cross section is compatible with the rest of the apparatus and, preferably, identical to that of the ribbon 18. Since the bands 181 are rectilinear and, in principle, are not twisted, the detwister 53 may be dispensed with; it has been made retractable in the embodiment shown in FIGS. 1 to 3, its base plate 74 being articulated at 74.

To introduce the bands 181 into the drive assembly 7, the rollers 15 to 17 first must be retracted, by actuating the rams 21, 22, to engage a band 181 against the drive rollers 12 to 14. After such engagement, the mating rollers 14 to 17 are advanced by rams 21, 22 to grip the band 181. This engagement is usually effected manually. The bands 181 are temporarily stored, ready for use, in a rack composed of a lower receptacle 173, in the form of a box open at the top, and of a upper support 174 connected by a bracket 75 to the upper part of the column 67. The upper support 174 has the shape of a rectangular band, with its axis vertical, and with its front side 76 (FIG. 2) articulated about a horizontal axis 77, so that it can be opened and closed by the action of a pneumatic ram 78 when it is desired to insert and retain the bands 181. This operation thus is carried out by lifting slightly one of the bands 181 to remove it from the lower receptacle 173 and to engage it in the drive assembly 7, as has been mentioned above.

To carry out the additions, tubular bars 181 also can be provided, with the addition products placed in them in an appropriate granular or powdery form. The bar then is propelled downward at an appropriate speed by the drive assembly 7 to insert it properly into the bath of liquid steel.

According to a preferred modification of the invention, the injections of the addition products may be made in the manner which now will be described. Cylindrical receptacles 79 (FIGS. 2, 3, 4) are provided, of steel, for example, and are filled with the requisite quantity of the addition products and closed by means of a crimped bottom made of a material which is destroyed more or less quickly in the bath of molten steel, for example, a bottom of cardboard, or aluminum, or even of steel so that it is destroyed at the same time as the rest of the receptacle 79. The top of the receptacle 79 is provided with a female connector 80 for reception of the lower end of a bar 181. Corresponding holes (not shown) are provided at the end of the band or bar 181 and in the female connector 80, so that a locking pin (also not shown) can be slid n and set in some manner, for example, by a hammer blow. The bar 181 is attached to the receptacle 79 on a receptacle support device generally referenced by 81 and composed of two trapdoors 82, 83 (FIG. 4) slidable in opposite directions in two guidways 84, 85 (FIG. 2) under the action of two double acting pneumatic rams 86, 87 (FIGS. 1, 4; the rams are not shown in FIGS. 2 and 3, to keep the drawing clear). Each of the slidable trapdoors 82, 83 is protected from the radiation from the molten steel by a refractory material, particularly alumina.

Figure 4:
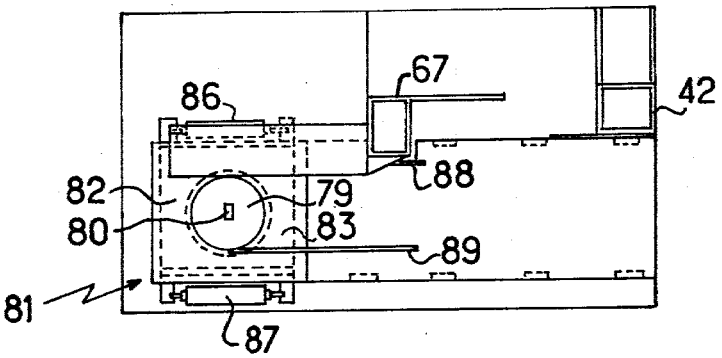
FIG. 4 is a section along line I—I of FIG. 3.

To introduce granular or powdery addition products into the bath of molten steel, apart from the possibility of providing tubular bars 181 containing them, the receptacles 79 may be advantageously be used, the desired number being made ready on the support device 81 as shown in FIG. 3. With the trapdoors 82 and 83 closed, a receptacle 79 is placed on top of them with its connector 80 located below the drive assembly 7 is a suitable position in the path of the bar 181. This is facilitated by the guides 88 and 89 (FIG. 4). A bar 181 is removed from the rack and introduced into the drive assembly 7 so as to fix its end in the connector 80. Then, the trapdoors 82, 83 are opened by means of the rams 86, 87 and the drive assembly 7 started at the proper speed to propel simultaneously the receptacle 79 and the bar 181 vertically into the bath of molten metal. The whole melts rapidly in the bath and is incorporated into the steel. The metal of the bar may be of any type, and can contribute to the addition; it can also be simply of steel, which melts in the bath contained in the ladle.

A more detailed description of the slideways 84, 85 and of the trapdoors 82, 83 as well as their drive device is not necessary, as they are completely conventional and known in elementary mechanical technology.

The shape of the receptacles 79 preferably is cylindrical, but this shape could be varied without in any way changing the nature of the invention.

The opposing edges of trapdoors 82, 83 include complemental notches forming an opening 90 (FIG. 1) in which can be placed a guide 91 in the form of a funnel, when a metered length of the ribbon or band 18 of aluminum is injected.

It can be seen that with the device of the invention there can be introduced:

(a) metered quantities of granular or powdery addition products in receptacles 79;

(b) rectilinear bands or bars 181 of appropriate metal of precise length and weight;

(c) a metal ribbon or band 18 in rectilinear, generally of aluminum, of great length; these additions being carried out by a perfectly rectilinear, flat band 18 or bar 181, in an absolutely vertical direction and at an appropriate speed so that they are propelled to the bottom of the molten steel bath, by means of the drive assembly 7, the detwister 53 and the guide wheel 39 acting in combination as a band straightening and injection means.

It goes without saying that the forms, details, basic materials and various arrangements can vary without departing from the scope of the invention. The accompanying Figures show a certain range of various possible embodiments, but these are not limitative; the invention being defined by the claims which follow.

I claim:

1. Apparatus for improving the efficiency of the deoxidation, desulfurization and purification of molten steel in a pouring ladle, including means for injecting a band of metal into molten steel in a ladle, a supply of bands disposed proximate said injection means, and a drive assembly located above and proximate to the molten steel in the ladle for pulling on a band to direct it downward, maintain it in straight condition and propel it toward the ladle so it enters the surface of the liquid steel perpendicularly, the said drive assembly includng a series of drive rollers on one side of the band and a series of mating rollers on the other side of the band, to grip and drive the band, the mating rollers being mounted on a yoke which can be moved toward and away from the drive rollers by the action of rams, characterized by means to inject a selected quantity of addition products and of a band of metal which is as rectilinear as possible, comprising:

(a) means for precisely metering the length of a band supplied to the molten steel, (b) receptacles for containing the addition products adapted to be fixed to the lower end of each band, the material constituting the receptacles being chosen so as to be destroyed only at the moment when the receptacle has reached the bottom of a ladle full of molten steel with the band which pushes it there, and (c) a trapdoor above the ladle for supporting the receptacles and adapted to open at the moment of the descent of a band with the receptacle which it pushes downward.

2. Apparatus such as defined in claim 1, characterized in that the trapdoor comprises two slidable components slidable in opposite directions under the action of at least one double acting ram, and each of the trapdoor components is protected underneath by a refractory material.

3. Apparatus such as defined in claim 1, characterized in that bands of selected length, before being engaged by the drive assembly, are stored in a rack composed of a lower receptacle in the form of a box open at the top and an upper support in the form of a rectangular band having one side which opens and closes under control to permit storage of the bands.

4. Apparatus such as defined in claims 1, 2 or 3, characterized in that the receptacles containing the addition products include, on the top, a female connector for engagement with the lower ends of the bands, corresponding holes being provided in each connector and band for engagement of a locking pin.

5. Improvements in apparatus for injecting a continuous ribbon of aluminum into molten steel which includes an unwinder supporting at least one reel of ribbon, characterized by means to inject a selected quantity of aluminum in strip form and as rectilinear as possible, and a selected quantity of addition products, in a direction perpendicular to the surface of the molten steel, deep into the molten steel close to the bottom thereof, including:

(a) a ribbon wound helicoidally on a reel on the unwinder, (b) a reel whereof its axis is adapted to oscillate with an axial movement of amplitude substantially equal to the width of the reel, according to the helicoidal movement of the ribbon as it unwinds from the reel, (c) a guide wheel for deflecting the unwinding ribbon vertically downward toward the molten steel, the said guide wheel having a groove with flanges which act on the ribbon to axially displace the reel during unwinding, the said wheel also including means for precisely metering the length of ribbon unwound, (d) a detwister to flatten the unwinding ribbon as it advances toward the molten steel and (e) a drive assembly located between the detwister and the molten steel in proximity to the surface of the molten steel, said drive assembly including drive rollers operative to grip the unwinding ribbon and propel it vertically into the molten steel, (f) said guide wheel, detwister and drive assembly being in substantially vertical alignment above the surface of the molten steel.

6. Apparatus such as defined in claim 5, characterized in that the reel is supported by a smooth horizontal axle having a length at least twice the width of the reel, the hub of the said reel including self-lubricating bearings, whereby the reel rotates very freely while easily being displaced axially during the course of unwinding.

7. Apparatus such as defined in claim 5, characterized in that the guide wheel includes a material having a high coefficient of friction at the bottom of its groove and studs uniformly spaced arcuately on one of its flanges, said studs cooperating with a fixed detector which emits measuring pulses to a counter which controls the starting and stopping of the motor of the drive assembly for the ribbon, the angular distance between the studs corresponding to a selected length of the ribbon in relation to its weight.

8. Apparatus such as defined in claim 5, 6 or 7, characterized in that the detwister is composed of two series of rollers with their axes parallel to axes of the rollers of a drive assembly located in advance of the detwister, the said series of rollers each gripping opposite halves of the ribbon and being displaceable in opposite directions, perpendicularly to the widest side of the ribbon.

9. Apparatus such as defined in claims 1, 2, 3, or 10, characterized in that the drive assembly constitutes an assembly mounted on a removable plate so as to be easily interchangeable.

10. Apparatus such as defined in claims5, 6 or 7, characterized in that the unwinder comprises two reels on a single axle, supported at its middle by a vertical, pivotal column which can be locked in two unwinding positions.

11. Apparatus such as defined in claims 1, 2, or 3 characterized in that the trapdoor includes notches forming an opening for a funnel-shaped guide for the aluminum.

12. Apparatus such as defined in claims 5, 6 or 7, characterized in that the detwister is mounted on an articulated support which permits the detwister to be placed out of action.

13. Apparatus such as defined in claims 5, 6 or 7, characterized in that the aluminum is a cold-rolled strip of aluminum which is flattened and has rounded edges, a width equal to about twice its thickness and a cross section comprised between 150 and 450 $mm^2$.

14. Apparatus such as defined in claim 13, characterized in that the aluminum strip has a purity of at least 99.5%, a cross section of 300 $mm^2$ and a Brinnell hardness of about 23.

15. In apparatus for improving the efficiency of the deoxidation, desulfurization and purification of molten steel in a pouring ladle, by the injection of a band of metal and/or a selected quantity of a granular or powdery addition product into a bath of molten steel in a ladle, means for propelling vertically a band of metal of selected length in rectilinear form perpendicularly to the surface of the molten bath deep into the molten bath, close to the bottom of the ladle, comprising (a) a drive assembly for the band located above and proximate to the molten bath, said drive assembly including a series of drive rollers and a series of mating rollers operative to grip the band and propel it vertically into the bath, (b) a grooved guide wheel disposed above the drive assembly for directing the band toward the drive assembly, (c) supply means disposed proximate the drive assembly for providing the drive assembly with a band of selected length in rectilinear form and (d) a normally closed protective trapdoor for the drive assembly disposed between the drive assembly and the molten bath, (e) said trapdoor including at least one slidable component and actuating means for retracting the slidable component to open the trapdoor.

16. The apparatus of claim 18, wherein the supply means includes (a) a reel containing a band wound thereon in ribbon form and (b) retractable detwisting means disposed between the grooved guide wheel and the drive assembly for rendering the band rectilinear after it is unwound from the reel.

17. The apparatus of claim 18, wherein the supply means comprises (a) a plurality of individual rectilinear bands of selected length and (b) a storage rack for the bands comprising (i) a lower receptacle open at the top, (ii) an upper hollow support in the form of a closed band having a pivotal gate formed therein and (iii) actuating means operative to open and close the gate selectively for the purpose of storing the bands in the rack and removing the bands from the rack preparatory to injecting a band into the bath of molten steel.

18. The apparatus of claim 15, further including (a) receptacles containing addition products adapted to be attached to the lower end of each band, the material constituting the receptacles being selected so as to be destroyed when a receptacle has reached the bottom of the molten bath in the ladle after the band to which the receptacle is affixed has been propelled into the molten bath, and (b) a trapdoor constituted of two slidable components retractacle in opposite directions under the action of the trapdoor actuating means, said trapdoor actuating means being operative to open the two components of the trapdoor at the moment of the vertical descent of a band with a receptacle affixed thereto, each of the trapdoor components being protected underneath by a refractory material.

19. Apparatus such as defined in claims 1, 2 or 3, characterized in that the band is a cold-rolled strip of metal which is flattened and has rounded edges, a width equal to about twice its thickness and a cross section comprised between 150 and 450 $mm^2$.

* * * * *

UNITED STATES PATENT AND TRADEMARK OFFICE

CERTIFICATE OF CORRECTION

PATENT NO. : 4,239,192

DATED : December 16, 1980

INVENTOR(S) : Fernand Morival

It is certified that error appears in the above-identified patent and that said Letters Patent are hereby corrected as shown below:

Column 8, line 4, change "from" to --form--

Column 8, line 22 change "acct" to --act--

Column 10, line 2, change "74", second occurrence, to --74'--

Column 11, line 24, after "rectilinear" insert --form--

Column 13, line 10, change "10" to --7--

Column 14, line 10, change "18" to --15--

Column 14, line 18, change "18" to --15--

Column 14, line 40, change "retractacle" to --retractable--

Signed and Sealed this

*Seventeenth* Day of *March 1981*

[SEAL]

*Attest:*

RENE D. TEGTMEYER

*Attesting Officer*

*Acting Commissioner of Patents and Trademarks*